US012324480B2

(12) United States Patent
Ozawa et al.

(10) Patent No.: US 12,324,480 B2
(45) Date of Patent: Jun. 10, 2025

(54) SOLE AND FOOTWEAR

(71) Applicant: ASICS CORPORATION, Kobe (JP)

(72) Inventors: Keita Ozawa, Kobe (JP); Yoshihito Tahira, Kobe (JP); Genki Hatano, Kobe (JP); Yousuke Atarashi, Kobe (JP); Shingo Masumoto, Kobe (JP); Keishi Kitamoto, Kobe (JP); Hiroki Nakamura, Kobe (JP)

(73) Assignee: ASICS CORPORATION, Kobe (JP)

( * ) Notice: Subject to any disclaimer, the term of this patent is extended or adjusted under 35 U.S.C. 154(b) by 33 days.

(21) Appl. No.: 17/907,134

(22) PCT Filed: Apr. 13, 2020

(86) PCT No.: PCT/JP2020/016304
§ 371 (c)(1),
(2) Date: Sep. 23, 2022

(87) PCT Pub. No.: WO2021/210044
PCT Pub. Date: Oct. 21, 2021

(65) Prior Publication Data

US 2023/0108812 A1 Apr. 6, 2023

(51) Int. Cl.
*A43B 13/18* (2006.01)
*A43B 7/142* (2022.01)
(Continued)

(52) U.S. Cl.
CPC ..... *A43B 13/186* (2013.01); *A43B 7/142* (2013.01); *A43B 7/1425* (2013.01); *A43B 13/40* (2013.01)

(58) Field of Classification Search
CPC ..... A43B 13/186; A43B 13/40; A43B 13/18
(Continued)

(56) References Cited

U.S. PATENT DOCUMENTS 4,930,232 A * 6/1990 Engle ..... A43B 17/14 36/71
4,956,927 A * 9/1990 Misevich ..... A43B 13/14 36/11

(Continued)

FOREIGN PATENT DOCUMENTS

CN 201860897 U 6/2011
CN 108685261 A 10/2018

(Continued)

OTHER PUBLICATIONS

International Search Report issued in PCT/JP2020/016304; mailed Jul. 14, 2020.

(Continued)

*Primary Examiner* — Marie D Bays
(74) *Attorney, Agent, or Firm* — Studebaker Brackett PLLC

(57) ABSTRACT

A sole constituting a part of footwear includes a shock-absorbing part provided at least in a rearfoot region, the shock-absorbing part cushioning an impact applied to a heel of a foot upon landing, and a support part provided at least in a midfoot region, the support part being higher in rigidity than the shock-absorbing part and supporting a midfoot portion of the foot, the support part includes a support surface, the support surface being provided forward of the shock-absorbing part and having a shape extending from one end to the other end in a width direction, and the shock-absorbing part includes a recessed surface located at a height position lower than the support surface, and a plurality of columnar bodies each having a shape extending from the recessed surface to a height position identical in height to the support surface.

10 Claims, 16 Drawing Sheets

(51) Int. Cl.
*A43B 7/1425* (2022.01)
*A43B 13/40* (2006.01)

(58) Field of Classification Search
USPC ..... 36/28, 37
See application file for complete search history.

(56) References Cited

U.S. PATENT DOCUMENTS 5,092,060 A * 3/1992 Frachey ..... A43B 1/0072 36/114
5,233,767 A * 8/1993 Kramer ..... A43B 13/206 36/35 B
5,517,770 A * 5/1996 Martin ..... A43B 5/00 36/43
5,689,902 A * 11/1997 Juang ..... A43B 21/32 36/141
5,782,014 A * 7/1998 Peterson ..... A43B 13/18 36/35 B
5,853,844 A * 12/1998 Wen ..... A43B 13/181 52/177
5,918,383 A * 7/1999 Chee ..... A43B 13/40 36/35 B
6,178,662 B1 * 1/2001 Legatzke ..... A43B 7/146 36/43
6,598,321 B2 * 7/2003 Crane ..... A61F 5/14 36/43
7,134,223 B2 * 11/2006 Ganon ..... D05B 15/08 36/12
8,296,969 B2 * 10/2012 Granger ..... A43B 1/0009 36/173
2003/0061733 A1 * 4/2003 Karsten ..... A43B 21/26 36/43
2004/0128860 A1 7/2004 Smaldone et al.
2010/0281712 A1 * 11/2010 Campbell ..... B29D 35/12 36/35 R
2011/0214310 A1 * 9/2011 Rosenbaum ..... A43B 7/144 36/28
2014/0068965 A1 * 3/2014 Vattes ..... A43B 13/40 36/43
2015/0223560 A1 8/2015 Wawrousek et al.
2018/0055144 A1 * 3/2018 Bischoff ..... B29D 35/122
2018/0255870 A1 * 9/2018 Oda ..... A43B 7/1415
2019/0075884 A1 * 3/2019 Pearce ..... F16F 1/3737
2019/0090583 A1 3/2019 Sato et al.
2021/0015208 A1 1/2021 Yahata et al.
2023/0123675 A1 * 4/2023 Ozawa ..... A43B 13/188 36/28

FOREIGN PATENT DOCUMENTS

JP H02-271804 A 11/1990
JP 3049755 U 6/1998
JP 2019-063491 A 4/2019
JP 2019-165937 A 10/2019

OTHER PUBLICATIONS

The extended European search report issued by the European Patent Office on Apr. 14, 2023, which corresponds to European Patent Application No. 20931350.1-1015 and is related to U.S. Appl. 17/907,134.
An Office Action; mailed by the China National Intellectual Property Administration of the People's Republic of China on Feb. 28, 2025, which corresponds to Chinese Patent Application No. 202080099660.3 and is related to U.S. Appl. No. 17/907,134.

* cited by examiner

SOLE AND FOOTWEAR

TECHNICAL FIELD

This disclosure relates to a sole and footwear.

BACKGROUND ART

Conventionally, footwear having a structure for cushioning an impact applied to a foot upon landing is known. For example, US 2015/0223560 A discloses a midsole having a plurality of convex elements. The plurality of convex elements each have a shape extending from a recessed surface provided on a surface of the midsole to the surface of the midsole. The plurality of convex elements are formed all over the midsole.

CITATION LIST

Patent Literature

PTL 1: US 2015/0223560 A

SUMMARY OF INVENTION

Technical Problem

During action such as running, a relatively large impact is applied particularly to a heel portion upon landing, and thus there are needs to prevent collapse of an arch of the foot (medial longitudinal arch and lateral longitudinal arch) while cushioning the impact.

It is therefore an object of the present disclosure to provide a sole and footwear capable of achieving both cushioning against an impact applied to a heel upon landing and prevention of collapse of an arch of a foot.

Solution to Problem

A sole according to one aspect of this disclosure is a sole constituting a part of footwear, the sole including a shock-absorbing part provided at least in a rearfoot region located at a rear of the footwear in a longitudinal direction, the shock-absorbing part cushioning an impact applied to a heel of a foot upon landing, and a support part provided at least in a midfoot region located at a center of the footwear in the longitudinal direction, the support part being higher in rigidity than the shock-absorbing part and supporting a midfoot portion of the foot, the support part includes a support surface, the support surface being provided forward of the shock-absorbing part and having a shape extending from one end to the other end of the footwear in a width direction, and the shock-absorbing part includes a recessed surface located at a height position lower than the support surface, and a plurality of columnar bodies each having a shape extending from the recessed surface to a height position identical in height to the support surface.

Further, footwear according to one aspect of this disclosure includes the sole and an upper connected to the sole and located on the sole.

Advantageous Effects of Invention

According to this disclosure, it is possible to provide the sole and footwear capable of achieving both cushioning against an impact applied to a heel upon landing and prevention of collapse of an arch of a foot.

DESCRIPTION OF EMBODIMENTS

Figure 1:
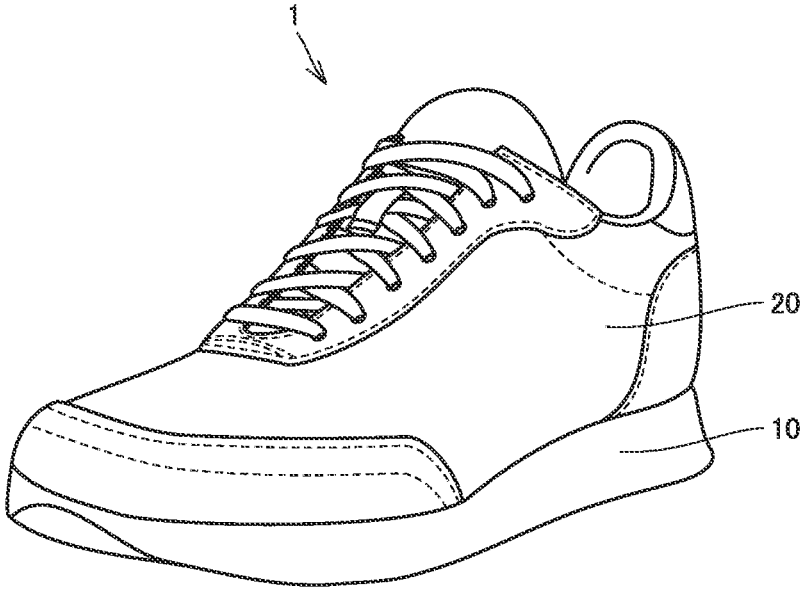
FIG. 1 is a schematic perspective view of footwear according to a first embodiment of the present disclosure.

Embodiments according to this invention will be described with reference to the drawings. Note that, in the drawings to be referenced below, the same or corresponding members are denoted by the same reference numerals. In the following description, terms such as longitudinal direction, width direction, fore, and rear are used. Such directional terms indicate directions viewed from the viewpoint of a wearer wearing footwear 1 placed on a flat surface such as the ground. For example, the fore refers to a toe side, and the rear refers to a heel side. Further, a medial side refers to a first toe side of the foot in the width direction, and a lateral side refers to a fifth toe side of the foot in the width direction.

First Embodiment

Figure 2:
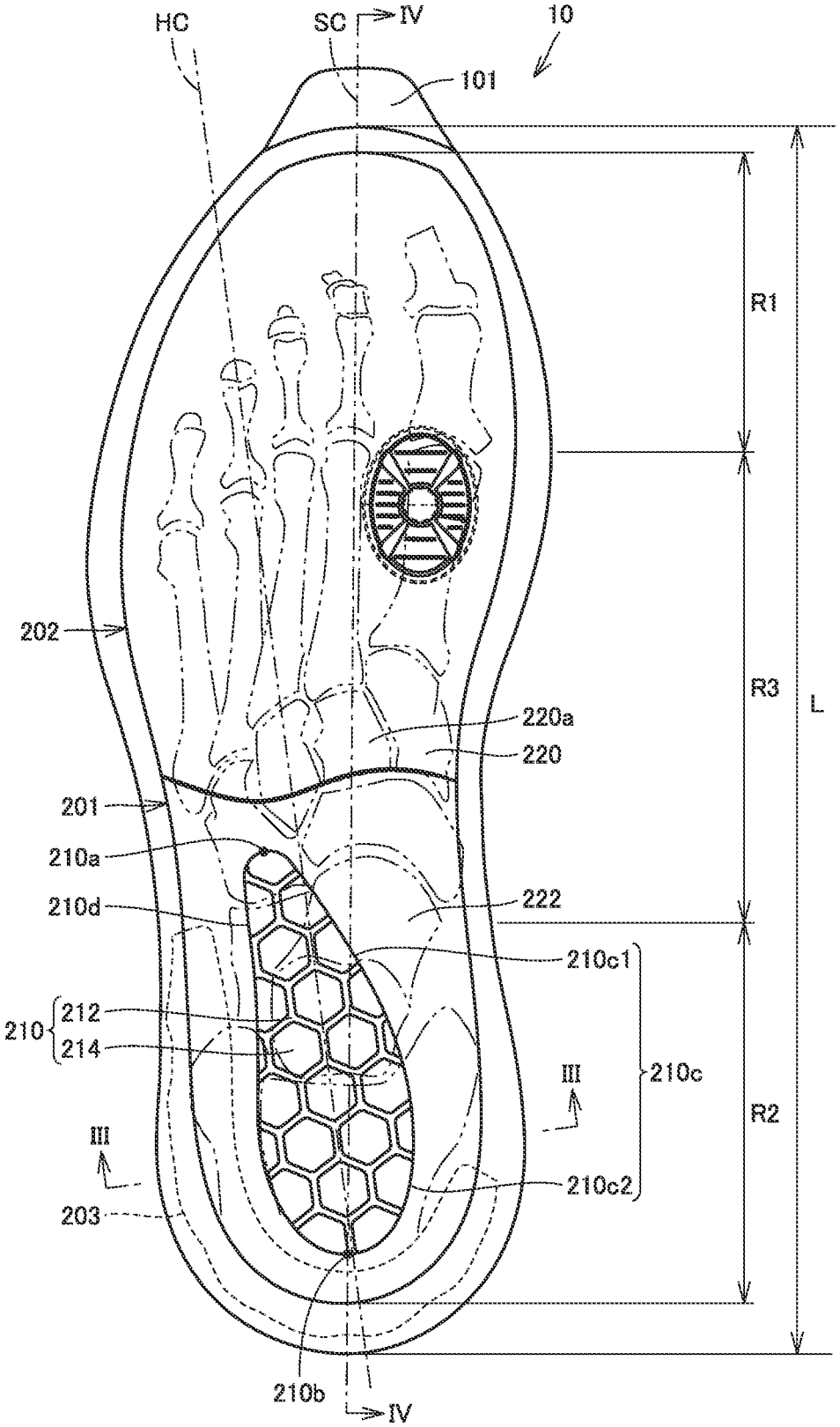
FIG. 2 is a plan view of a sole.
Figure 3:
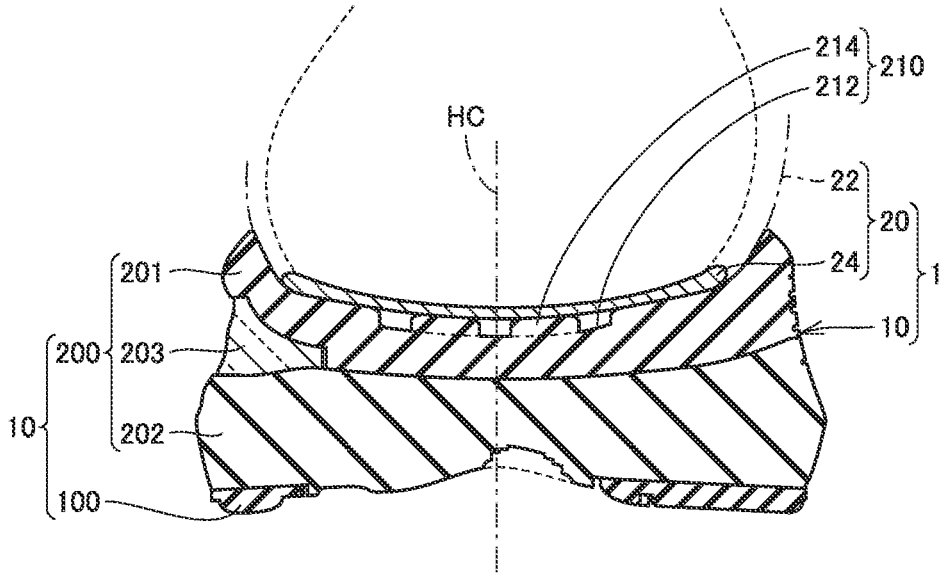
FIG. 3 is a cross-sectional view taken along line III-III in FIG. 2.
Figure 4:
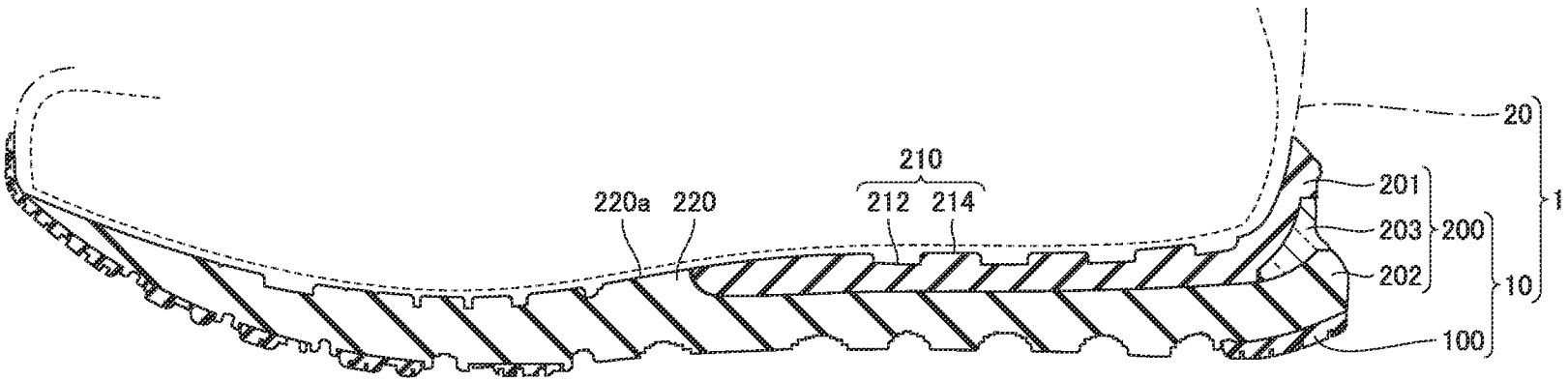
FIG. 4 is a cross-sectional view taken along line IV-TV in FIG. 2.

FIG. 1 is a schematic perspective view of footwear according to a first embodiment of the present disclosure. FIG. 2 is a plan view of a sole. FIG. 3 is a cross-sectional view taken along line III-III in FIG. 2. FIG. 4 is a cross-sectional view taken along line IV-IV in FIG. 2. Note that FIG. 2 illustrates a sole 10 for the left foot, but this sole 10 is also applicable to the right foot, and in this case, the sole 10 for the right foot and the sole 10 for the left foot are symmetrical. Footwear 1 according to the present embodiment is suitable for running shoes, for example, but is also applicable to other athletic shoes or walking shoes, and there is no limitation on the use of the footwear.

As illustrated in FIGS. 1, 3, and 4, the footwear 1 includes the sole 10 and an upper 20.

The upper 20 is connected to the sole 10 to form a space for accommodating a foot with the sole 10. As illustrated in FIG. 3, the upper 20 includes an upper main body 22 and an insole 24. The upper main body 22 covers an upper surface of the foot. The insole 24 is connected to a lower portion of the upper main body 22 to constitute a bottom portion of the upper 20. The insole 24 is connected to a surface of the sole 10.

The sole 10 constitutes a part of the footwear 1. The sole 10 is connected to a lower portion of the upper 20. The sole 10 includes an outer sole 100 and a midsole 200.

The outer sole 100 constitutes a tread portion. The outer sole 100 is made of rubber or the like.

The midsole 200 is provided on the outer sole 100. The upper 20 is disposed on the midsole 200. That is, the midsole 200 is provided between the upper 20 and the outer sole 100.

The midsole 200 is formed of, for example, a resin foam material containing a resin material as a main component and a foaming agent and a cross-linking agent as accessory components. As the resin material, a thermoplastic resin and a thermosetting resin can be used. As the thermoplastic resin, for example, an ethylene-vinyl acetate copolymer (EVA) can be suitably used. As the thermosetting resin, for example, polyurethane (PU) can be suitably used. Alternatively, the midsole 200 may be formed of a rubber foam material containing a rubber material as a main component and a plasticizer, a foaming agent, a reinforcing agent, and a cross-linking agent as accessory components. As the rubber material, for example, a butadiene rubber can be suitably used. Note that the material of the midsole 200 is not limited to the above-described materials, and the midsole 200 may be formed of a resin or rubber material having an appropriate strength and excellent shock-absorbing property.

The midsole 200 includes a forefoot region R1, a rearfoot region R2, and a midfoot region R3. The forefoot region R1 is a region located at a fore part of the footwear 1 in the longitudinal direction. The rearfoot region R2 is a region located at a rear of the footwear 1 in the longitudinal direction. The midfoot region R3 is a region located between the forefoot region R1 and the rearfoot region R2.

The forefoot region R1 is a region extending over a range of about 0% to 30% of an entire length of the footwear 1 from a fore end part to a rear end part of the footwear 1. The midfoot region R3 is a region extending over a range of about 30% to 80% of the entire length of the footwear 1 from the fore end part to the rear end part of footwear 1. The rearfoot region R2 is a region extending over a range of 80% to 100% of the entire length of the footwear 1 from the fore end part to the rear end part of the footwear 1.

As illustrated in FIG. 2, the midsole 200 includes a shock-absorbing part 210 and a support part 220.

The shock-absorbing part 210 is a portion that cushions an impact applied to the heel of the foot upon landing. The shock-absorbing part 210 is provided at least in the rearfoot region R2. In the present embodiment, the shock-absorbing part 210 is provided over a region extending from the rearfoot region R2 to a rear of the midfoot region R3. The shock-absorbing part 210 is preferably formed over a range of 50% or less from the rear end part of the footwear 1 along a center line SC (see FIG. 2) of the footwear 1. Note that the center line SC is not limited to the center line of the footwear 1, and may be a line corresponding to a straight line connecting a center of a calcaneus of a typical wearer of the footwear 1, and a gap between the first toe and the second toe.

The shock-absorbing part 210 includes a fore end part 210*a*, a rear end part 210*b*, a medial edge part 210*c*, and a lateral edge part 210*d*.

The fore end part 210*a* is a portion located at a fore end in the longitudinal direction. As illustrated in FIG. 2, the fore end part 210*a* is located on the lateral side relative to the center line SC in the width direction.

The rear end part 210*b* is a portion located at a rear end in the longitudinal direction. As illustrated in FIG. 2, the rear end part 210*b* is located roughly on the center line SC.

The medial edge part 210*c* connects the fore end part 210*a* and the rear end part 210*b*, and constitutes a medial edge of the shock-absorbing part 210 in the width direction. The medial edge part 210*c* includes a fore edge part 210*c*1 and a rear edge part 210*c*2.

The fore edge part 210*c*1 constitutes a fore portion of the medial edge part 210*c* in the longitudinal direction. The fore edge part 210*cl* has a shape gradually extending toward the medial side in the width direction while extending from the fore end part 210*a* toward the rear end part 210*b*. In the present embodiment, the fore edge part 210*c*1 has a shape curved toward the medial side in the width direction. Note that the fore edge part 210*c*1 may have a shape curved toward the lateral side in the width direction, or may be formed in a linear shape.

The rear edge part 210*c*2 constitutes a rear portion of the medial edge part 210*c* in the longitudinal direction. The rear edge part 210*c*2 has a shape gradually extending toward the lateral side in the width direction while extending toward the rear end part 210*b*. In the present embodiment, the rear edge part 210*c*2 has a shape curved toward the medial side in the width direction. Note that the rear edge part 210*c*2 may have a shape curved toward the lateral side in the width direction, or may be formed in a linear shape The lateral edge part 210*d* connects the fore end part 210*a* and the rear end part 210*b*, and constitutes a lateral edge of the shock-absorbing part 210 in the width direction.

The shock-absorbing part 210 includes a recessed surface 212 and a plurality of columnar bodies 214.

Figure 6:
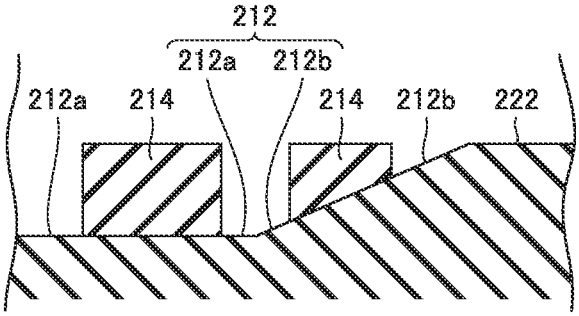
FIG. 6 is a cross-sectional view taken along line VI-VI in FIG. 5.

The recessed surface 212 is located at a height position lower than a surface (including a support surface 200*a* to be described later) of a portion around the shock-absorbing part 210 of the midsole 200. As illustrated in FIG. 6, the recessed surface 212 includes a base surface 212*a* and an inclined surface 212*b*.

The base surface 212*a* is substantially parallel to a surface of each columnar body 214.

Figure 5:
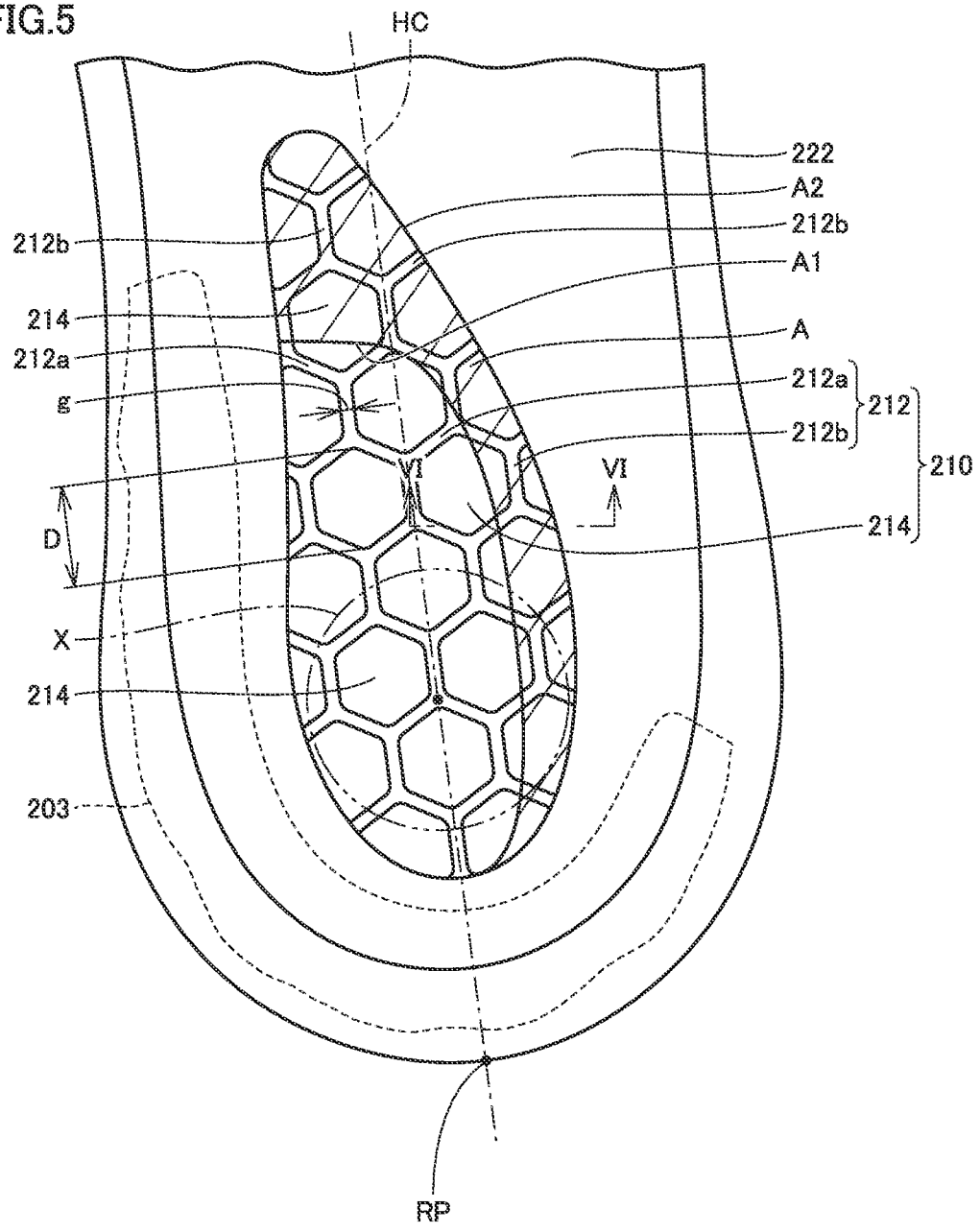
FIG. 5 is a plan view of a shock-absorbing part and a part in the vicinity of the shock-absorbing part.

The inclined surface 212*b* is inclined relative to the base surface 212*a*. The inclined surface 212*b* is formed in a region A (a hatched region in FIG. 5) including the medial edge part 210*c*. The inclined surface 212*b* has a shape inclined so as to gradually come close to the surface of each columnar body 214 while extending from an edge part A1, located in the shock-absorbing part 210, of the region. A toward an outer edge A2 of the shock-absorbing part 210. For example, in a cross section taken along line VI-VI in FIG. 5, as illustrated in FIG. 6, the inclined surface 212*b* has a shape inclined so as to gradually come close to the surface of each columnar body 214 while extending from the lateral side toward the medial side in the width direction. The inclined surface 212*b* may be formed flat as illustrated in FIG. 6, may be formed so as to curve upward, or may be formed so as to curve downward. A rear end part of the region. A is located on the medial side relative to the center line SC in the width direction.

Each columnar body 214 has a shape extending from the recessed surface 212 to a height position the same in height as the support surface 220*a*. It is preferable that the surface of each columnar body 214 be formed in a polygonal shape as viewed from above, and it is particularly preferable that the surface of each columnar body 214 be formed in a polygonal shape with at least five sides. In the present embodiment, each columnar body 214 is formed in a hexagonal columnar shape. Note that corners of each columnar body 214 are not corners in the strict sense, and may be rounded or chamfered.

Figure 7:
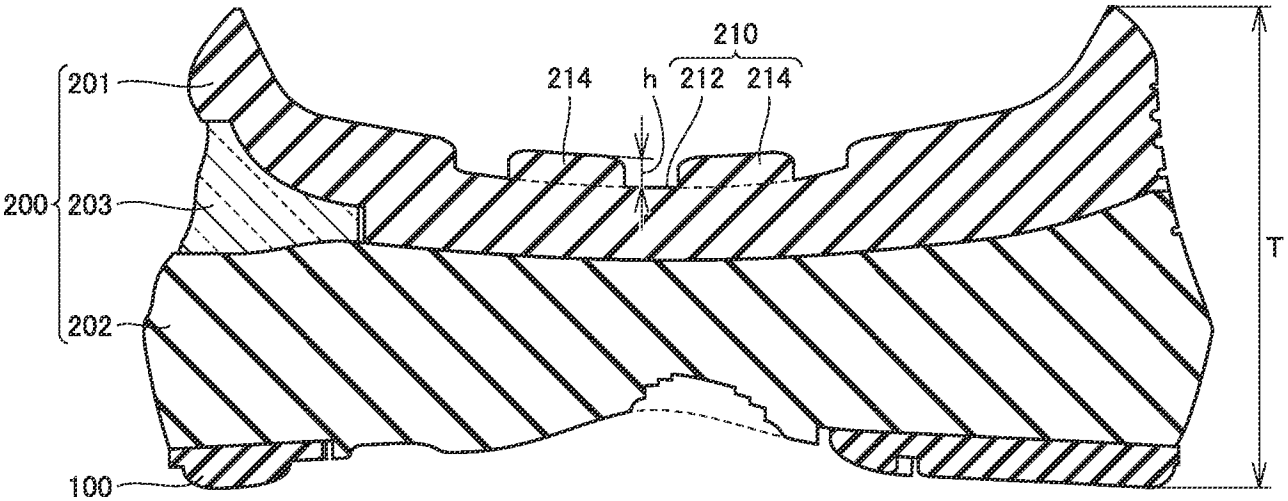
FIG. 7 is an enlarged cross-sectional view of the sole.

A dimension g (see FIG. 5) between a pair of columnar bodies 214 adjacent to each other is greater than or equal to a height dimension h (see FIG. 7) of the columnar bodies 214. The dimension g is less than a length of each side of the surface of each columnar body 214.

In the plan view of the columnar bodies 214, the largest dimension D (see FIG. 5) among the dimensions of the columnar bodies 214 in directions orthogonal to an axial direction of the columnar bodies 214 is greater than or equal to the height dimension h of the columnar bodies 214. The height dimension h is preferably set greater than or equal to 0.5 mm. The height dimension h is set less than or equal to 30% of a thickness T (see FIG. 7) of the sole 10. Note that the height dimension h means a distance from the recessed surface 212 to the surface of each columnar body 214.

A position of the columnar bodies 214 is set such that at least some of the columnar bodies 214 are arranged in a circle X (see FIG. 5) centered on a position corresponding to 15% to 25% of a dimension L (see FIG. 2) in a direction along the center line SC of a portion other than a rolled-up part 101 located at the toes of a contact surface of the outer sole 100 extending forward from a rear end part RP (see FIG. 5) of the contact surface of the outer sole 100 along a heel center HC. A diameter of the circle X is equal to 40% of a dimension between portions intersecting a straight line passing through the center of the edge part of the contact surface of the outer sole 100 and orthogonal to the heel center HC. In the present embodiment, a plurality of the columnar bodies 214 are arranged in the circle X. This circle X is located rearward of a fore end part of the edge part A1 in the longitudinal direction. Note that the heel center HC means a straight line connecting the center of the calcaneus of the typical wearer of the footwear 1, and a gap between the third toe and the fourth toe.

The support part 220 is higher in rigidity than the shock-absorbing part 210 and supports the midfoot portion of the foot. The support part 220 is provided at least in the midfoot region R3. Note that the rigidity is substantially synonymous with a modulus of compressive elasticity of the sole 10 in the thickness direction.

The support part 220 includes the support surface 220*a*. The support surface 220*a* is provided forward of the shock-absorbing part 210. Specifically, the support surface 220*a* constitutes a surface of a portion of the midsole 200 located forward of the shock-absorbing part 210. That is, the recessed surface 212 is located at a height position lower than the support surface 220*a*. The support surface 220*a* has a shape extending from one end to the other end in the width direction.

The support part 220 includes a medial support part 222. The medial support part 222 has a shape extending toward the medial side in the width direction from the medial edge part 210*c*. More specifically, the medial support part 222 has a shape extending toward the medial side in the width direction from the fore edge part 210*c*1. A surface of the medial support part 222 is contiguous with the support surface 220*a*.

Of the midsole 200, the surface of the portion around the shock-absorbing part 210, that is, the surface including the support surface 220*a* and the surface of the medial support part 222 is bonded to the insole 24 with an adhesive. On the other hand, the shock-absorbing part 210 is not bonded to the insole 24.

In the present embodiment, as illustrated in FIGS. 3, 4 and the like, the midsole 200 includes a top midsole 201, a bottom midsole 202, and a cushioning part 203.

The bottom midsole 202 is provided on the outer sole 100.

The top midsole 201 is connected to a surface of a rear of the bottom midsole 202. The shock-absorbing part 210 and the medial support part 222 are formed on a surface of the top midsole 201. The support part 220 is formed in the vicinity of a boundary between the top midsole 201 and the bottom midsole 202 as viewed from above (corresponding to FIG. 2).

The cushioning part 203 is a portion that absorbs an impact mainly applied to the heel upon landing. The cushioning part 203 is made of a material that is lower in hardness than the top midsole 201 and the bottom midsole 202. The cushioning part 203 is made of, for example, a foam material or a non-foam material of a polymer composition.

As illustrated in FIG. 2, the cushioning part 203 is provided around a rear of the shock-absorbing part 210. The cushioning part 203 is provided at a position not overlapping the shock-absorbing part 210 in the thickness direction of the sole 10. In other words, the cushioning part 203 is separated from the shock-absorbing part 210 as viewed from above. Note that the cushioning part 203 may be provided at a position overlapping the shock-absorbing part 210 in the thickness direction.

As described above, in the sole 10 according to the present embodiment, an impact applied to the heel upon landing is cushioned by the shock-absorbing part 210 provided in the rearfoot region R2, and the support part 220 that supports the midfoot portion (arch portion) of the foot includes the support surface 220*a* having a shape extending from one end to the other end of the footwear 1 in the width direction, so that the arch of the foot (medial longitudinal arch and lateral longitudinal arch) is prevented from collapsing.

Figure 8:
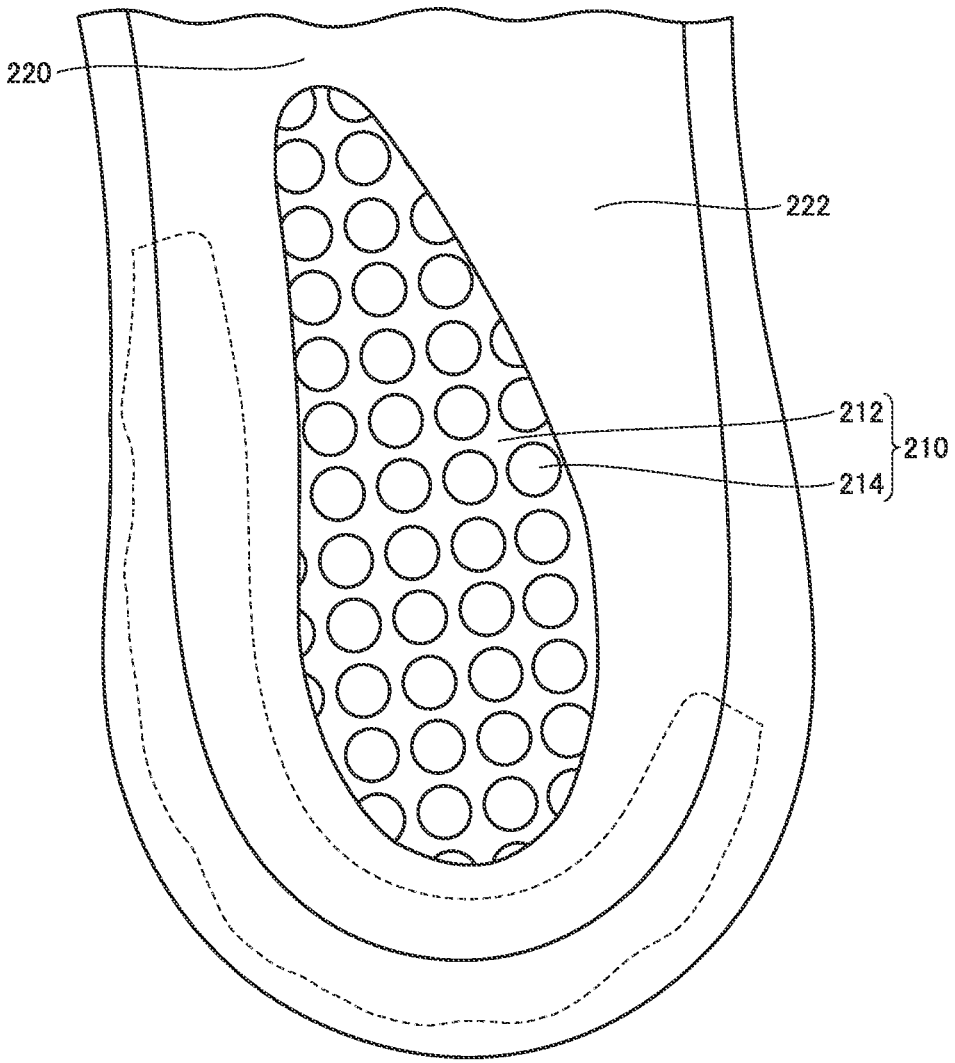
FIG. 8 is a plan view of a modification of a columnar body.
Figure 9:
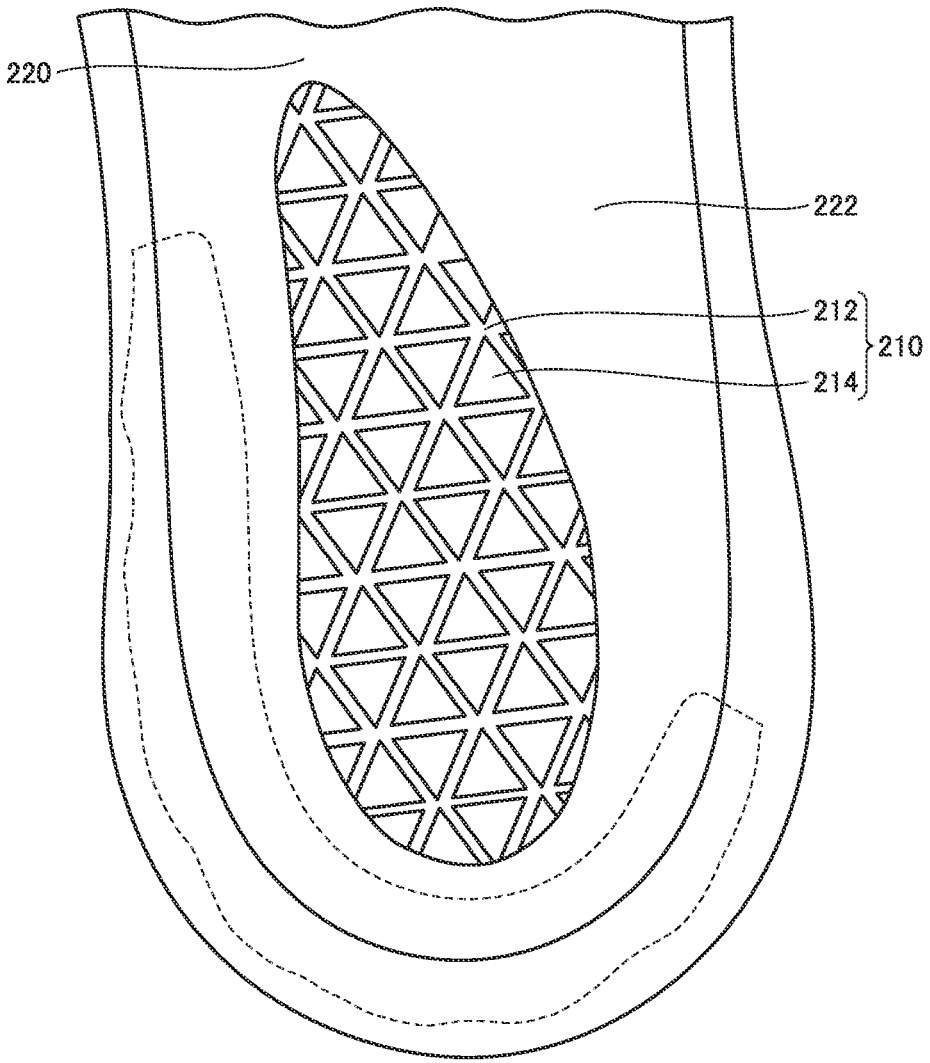
FIG. 9 is a plan view of a modification of the columnar body.

Note that, according to this embodiment, as illustrated in FIG. 8, each columnar body 214 may be formed in the shape of a cylinder. Alternatively, as illustrated in FIG. 9, each columnar body 214 may be formed in the shape of a triangular prism.

Figure 10:
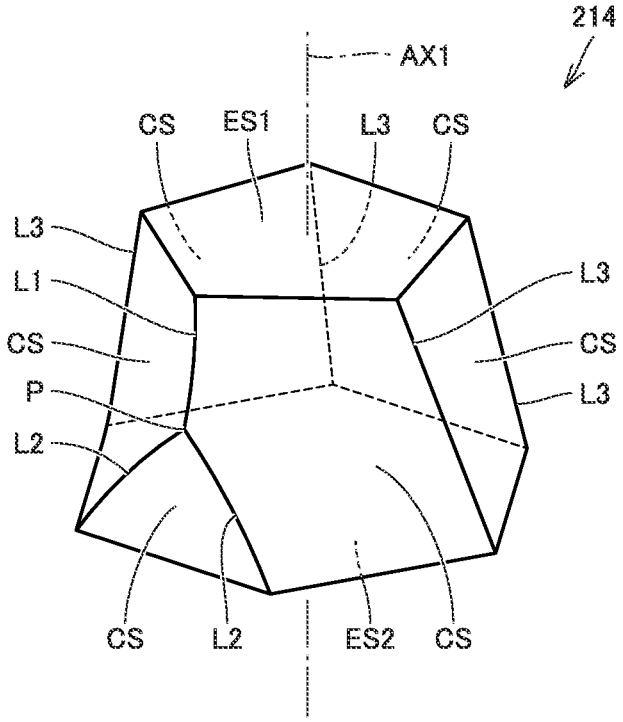
FIG. 10 is a perspective view of a modification of the columnar body.

Alternatively, as illustrated in FIG. 10, each columnar body 214 may include a shock-absorbing member having a columnar outer shape. The shock-absorbing member has, as an outer surface, a first end surface ES1 and a second end surface ES2 on opposite sides of the shock-absorbing member in an axial direction in which an axis AX1 extends, and a plurality of connection surfaces CS connecting a peripheral edge of the first end surface ES1 and a peripheral edge of the second end surface ES2.

The first end surface ES1 has an outer shape of an N-sided polygon (N is an integer greater than or equal to 3) as viewed along the axial direction. The second end surface ES2 has an outer shape of an M-sided polygon (M is an integer greater than or equal to 4 and greater than N) as viewed along the axial direction.

An (M–N) vertex P is provided at an intermediate position in the axial direction of a periphery defined by the plurality of connection surfaces CS. One first ridgeline L1 is provided so as to extend from the (M–N) vertex P to one of the N vertices of the first end surface ES1. Two second ridgelines L2 are provided so as to extend from the (M–N) vertex P to two vertices adjacent to each other in a peripheral direction among the M vertices of the second end surface ES2. (2*N–M) third ridgelines L3 are provided so as to extend from the remaining vertices of the N vertices of the first end surface ES1 to the remaining vertices of the M vertices of the second end surface ES2.

Ridgelines included in the first ridgeline L1, the second ridgelines L2, and the third ridgelines L3 do not intersect each other, and the plurality of connection surfaces CS are defined by the ridgelines included in the first ridgeline L1, the second ridgelines L2, and the third ridgelines L3.

In the example illustrated in FIG. 10, the first end surface ES1 is a flat surface having a pentagonal outer shape as viewed along the axial direction, and the second end surface ES2 is a flat surface having a hexagonal outer shape as viewed along the axial direction. That is, in this example, N is 5, and M is 6. Further, the number of vertices P is 1. The plurality of connection surfaces CS include a total of six curved surfaces including one curved surface having an approximately triangular outer shape, three curved surfaces having an approximately quadrangular outer shape, and two curved surfaces having an approximately pentagonal outer shape.

When a compressive load is applied to the shock-absorbing member along the axial direction, not only a stress field in which compressive deformation occurs in the shock-absorbing member along the axial direction but also a stress field in which shear deformation occurs are generated. This is because all of the plurality of connection surfaces CS each extend in a direction intersecting the axial direction, and thus a complicated stress field is generated due to such an outer shape. In other words, since a main axis of deformation of the shock-absorbing member is different from a load direction (that is, the axial direction of the shock-absorbing member), shearing deformation is much more likely to occur as compared with a polygonal or cylindrical shock-absorbing member in which the main axis coincides with the load direction Therefore, the more likely shear deformation is to occur, the larger the amount of deformation per volume, and high deformability is obtained accordingly. As a result, when each columnar body 214 is set as the above-described shock-absorbing member, a high shock-absorbing capability is exhibited.

Figure 11:
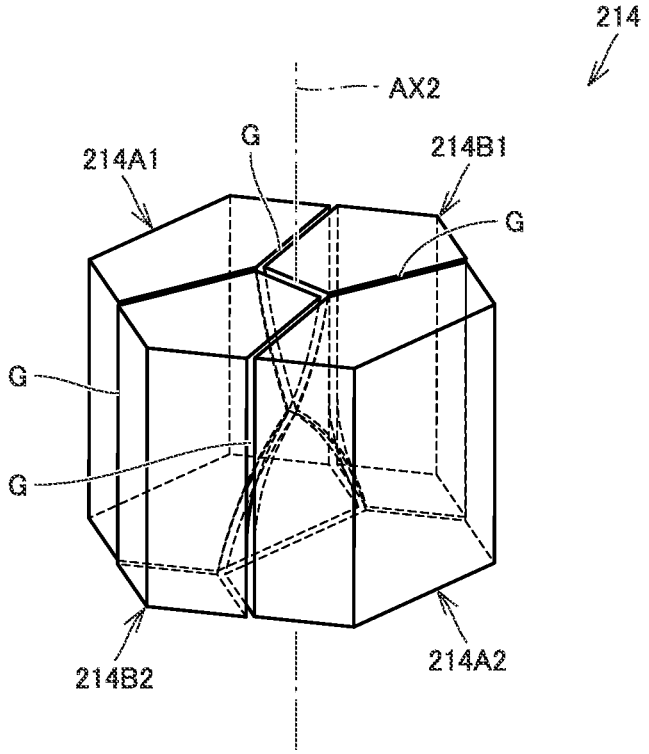
FIG. 11 is a perspective view of a modification of the columnar body
Figure 12:
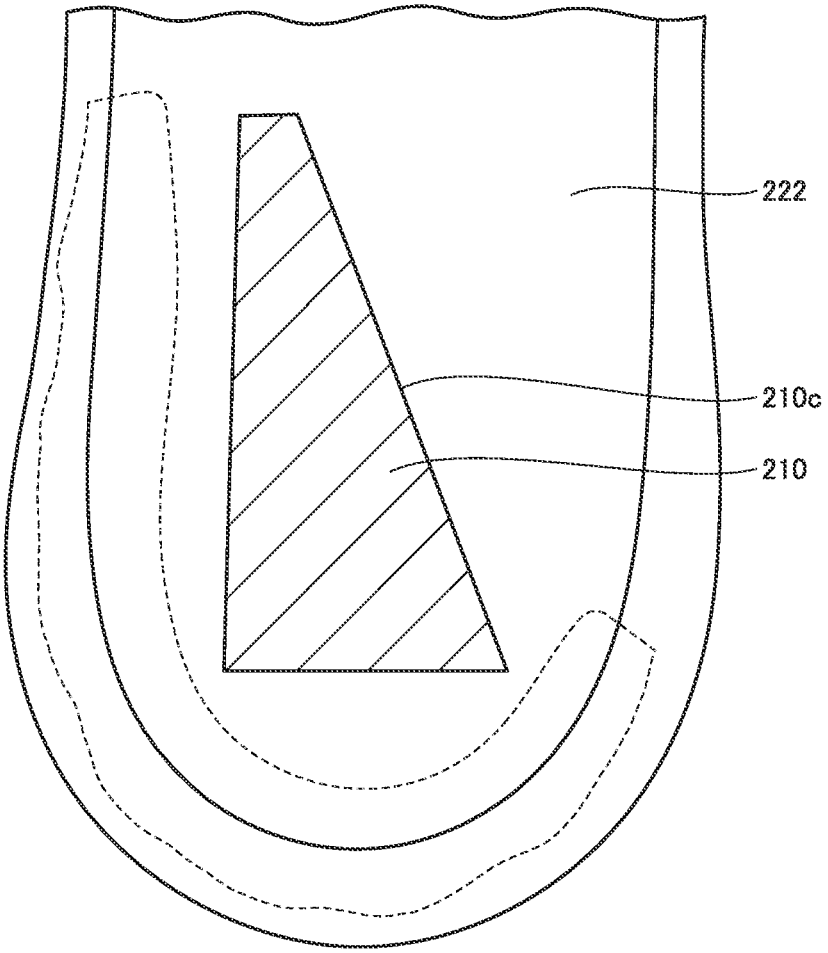
FIG. 12 is a diagram illustrating a modification of a region of the shock-absorbing part.
Figure 13:
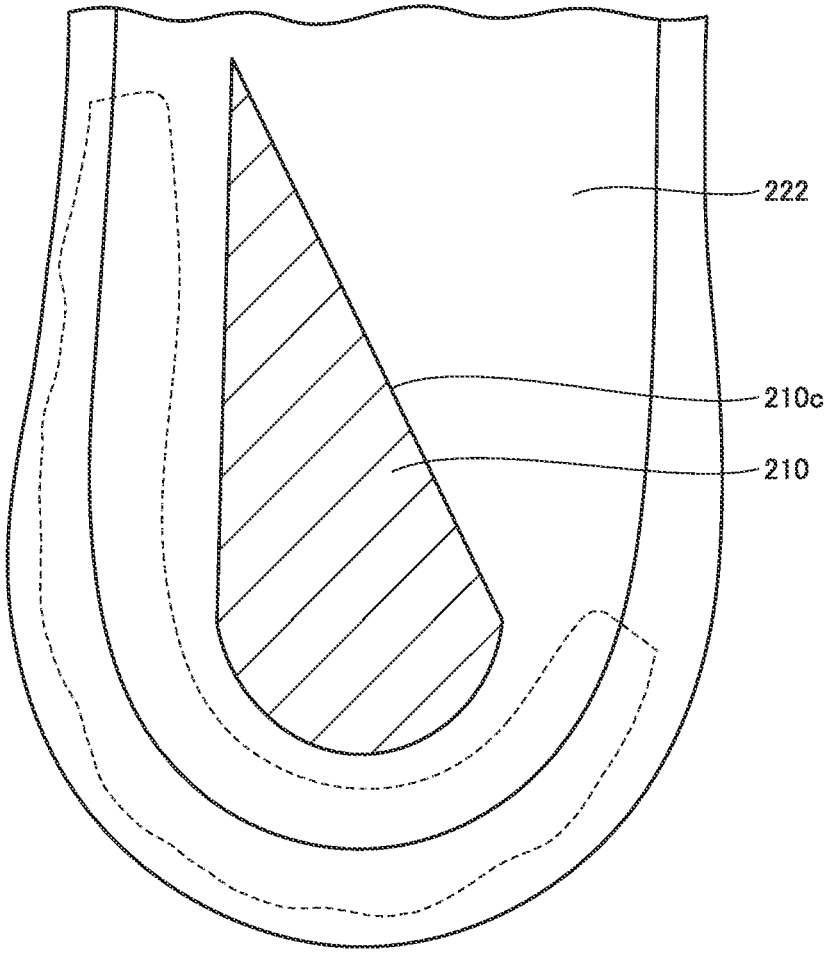
FIG. 13 is a diagram illustrating a modification of the region of the shock-absorbing part.
Figure 14:
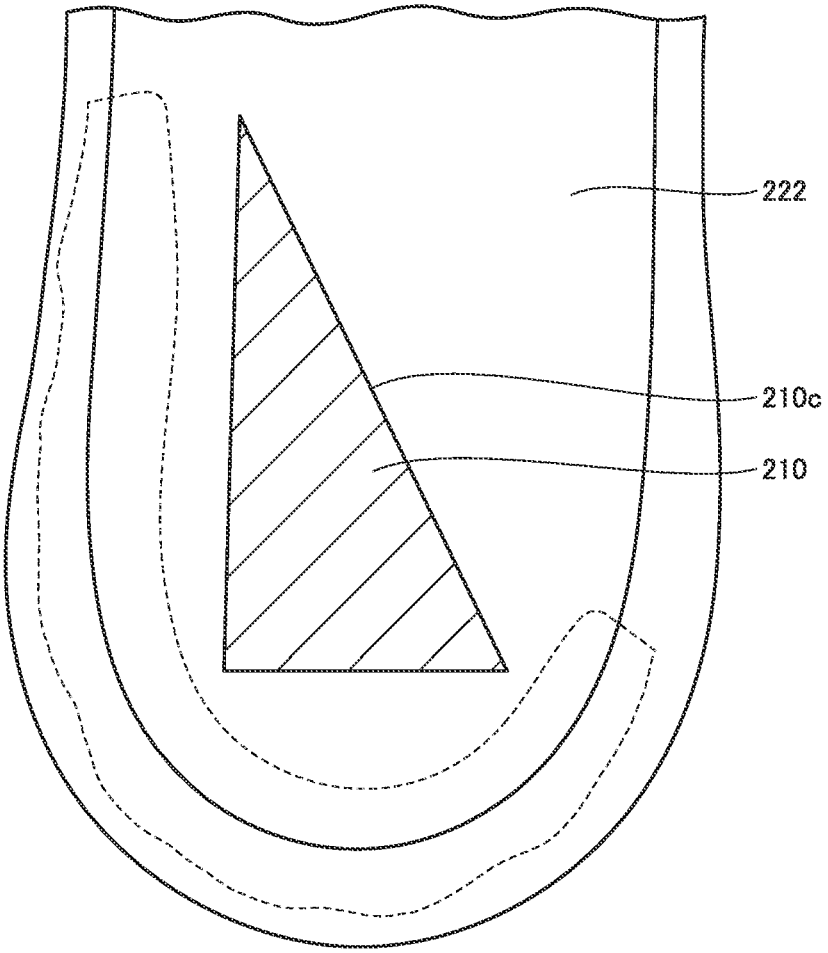
FIG. 14 is a diagram illustrating a modification of the region of the shock-absorbing part.
Figure 15:
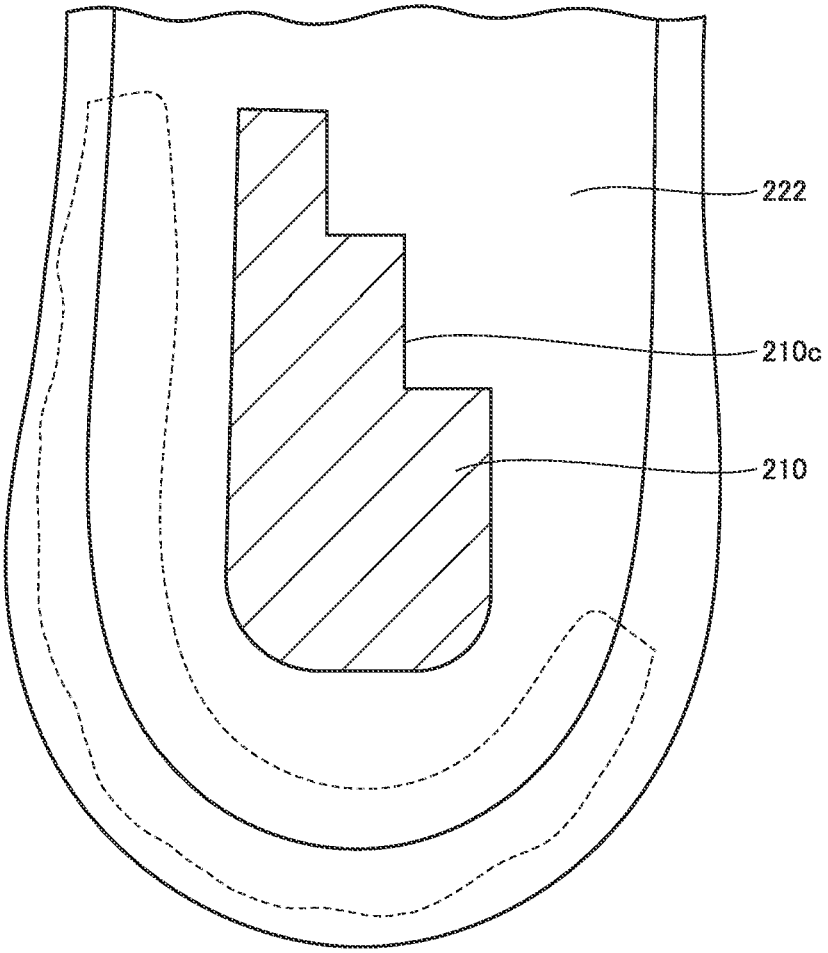
FIG. 15 is a diagram illustrating a modification of the region of the shock-absorbing part.

Alternatively, as illustrated in FIG. 11, each columnar body 214 may be formed of a shock-absorbing structure including a shock-absorbing unit obtained by unitizing a plurality of shock-absorbing members Each of the plurality of shock-absorbing members includes the shock-absorbing member illustrated in FIG. 10. The plurality of shock-absorbing members are arranged adjacent to each other so as to cause connection surfaces defined by the first ridgeline L1 and the second ridgelines L2 among the plurality of connection surfaces CS included in each shock-absorbing member to face each other with a gap G provided between the connection surfaces. A size of each gap G is approximately uniform.

In the example illustrated in FIG. 11, the plurality of shock-absorbing members include a total of four shock-absorbing members including two first shock-absorbing members each having the first end surface ES1 with a pentagonal shape and the second end surface ES2 with a hexagonal shape, and two second shock-absorbing members each having the first end surface ES1 with a quadrangular shape and the second end surface ES2 with a pentagonal shape. The two first shock-absorbing members and the two second shock-absorbing members are alternately arranged so as to surround an axis AX2 of the shock-absorbing unit and to make the two first shock-absorbing members and the two second shock-absorbing members opposite in orientation along the axial direction to each other. This causes the shock-absorbing unit to have an approximately hexagonal columnar outer shape as a whole.

This aspect also enhances the shock-absorbing capability of the shock-absorbing part 210.

Further, as illustrated in FIGS. 12 to 15, the formation region of the shock-absorbing part 210 can be variously changed.

Second Embodiment

Figure 16:
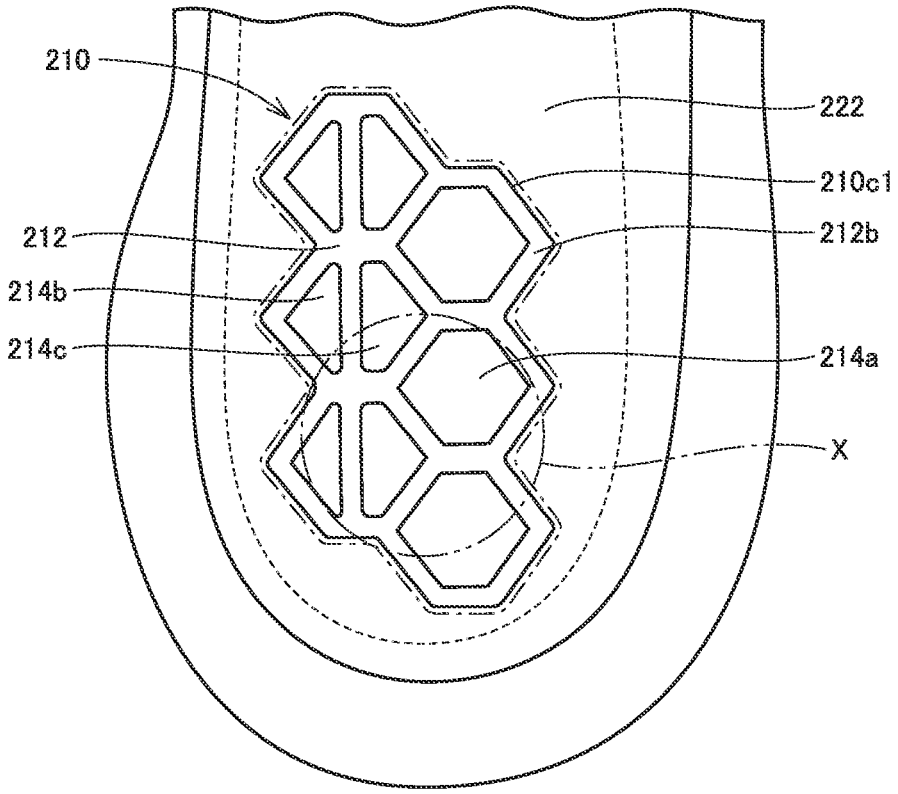
FIG. 16 is a plan view of a shock-absorbing part of a sole of footwear according to a second embodiment of the present disclosure.

Next, a shock-absorbing part 210 of a sole 10 according to a second embodiment of the present disclosure will be described with reference to FIG. 16. In the second embodiment, only parts different from those of the first embodiment will be described, and the description of the same structure, operation, and effect as those of the first embodiment will not be repeated.

In the present embodiment, the plurality of columnar bodies 214 of the shock-absorbing part 210 includes three medial columnar bodies 214*a* arranged so as to be aligned along the longitudinal direction on the medial side in the width direction, three lateral columnar bodies 214*b* arranged so as to be aligned along the longitudinal direction on the lateral side in the width direction, and three central columnar bodies 214*c* arranged so as to be aligned along the longitudinal direction between the medial columnar bodies 214*a* and the lateral columnar bodies 214*b*. A surface of each lateral columnar body 214*b* as viewed from above is formed in a triangular shape. A surface of each central columnar body 214*c* as viewed from above is formed in an approximately pentagonal shape. A recessed surface 212 is provided between the lateral columnar bodies 214*b* and the central columnar bodies 214*c*. An overall outer shape of a pair of the lateral columnar body 214*b* and the central columnar body 214*c* adjacent to each other in the width direction with the recessed surface 212 interposed between the lateral columnar body 214*b* and the central columnar body 214*c* is formed in an approximately hexagonal columnar shape.

It should be understood that the embodiments disclosed herein are illustrative in all respects and not restrictive. The scope of the present invention is defined by the claims rather than the above description, and the present invention is intended to include the claims, equivalents of the claims, and all modifications within the scope.

Aspect

It is to be understood by those skilled in the art that the plurality of exemplary embodiments described above are specific examples of the following aspects.

A sole 10 according to one aspect of this disclosure is a sole constituting a part of footwear, the sole including a shock-absorbing part 210 provided at least in a rearfoot region R2 located at a rear of the footwear in a longitudinal direction, the shock-absorbing part cushioning an impact applied to a heel of a foot upon landing, and a support part 220 provided at least in a midfoot region R3 located at a center of the footwear in the longitudinal direction, the support part being higher in rigidity than the shock-absorbing part and supporting a midfoot portion of the foot, the support part 220 includes a support surface 220*a*, the support surface being provided forward of the shock-absorbing part and having a shape extending from one end to the other end of the footwear in a width direction, and the shock-absorbing part 210 includes a recessed surface 212 located at a height position lower than the support surface, and a plurality of columnar bodies 214 each having a shape extending from the recessed surface to a height position identical in height to the support surface.

In this sole, an impact applied to the heel upon landing is cushioned by the shock-absorbing part 210 provided in the rearfoot region, and the support part 220 that supports the midfoot portion (arch portion) of the foot includes the support surface 220*a* having a shape extending from one end to the other end of the footwear 1 in the width direction, so that the arch of the foot (medial longitudinal arch and lateral longitudinal arch) is prevented from collapsing.

Further, in a plan view of the columnar bodies 214, it is preferable that a largest dimension D among dimensions of each of the columnar bodies in directions orthogonal to an axial direction of each of the columnar bodies be larger than a height dimension h of each of the columnar bodies, and that the height dimension h of each of the columnar bodies be less than or equal to 30% of a thickness T of the sole 10.

Accordingly, the deformation mode of each columnar body 214 when a load is applied to the shock-absorbing part 210 is mainly compression rather than shearing, so that a shock-absorbing effect can be effectively provided.

Further, it is preferable that the shock-absorbing part 210 include a fore end part 210*a* located at a fore end in the longitudinal direction, a rear end part 210*b* located at a rear end in the longitudinal direction, and a medial edge part 210*c* connecting the fore end part and the rear end part and constituting a medial edge of the shock-absorbing part in the width direction, that the fore end part 210*a* be located on a lateral side relative to a center line SC of the sole in the width direction, and that the support part 220 include a medial support part 222 having a shape extending from the medial edge part toward a medial side in the width direction.

This causes the shock-absorbing part 210 relatively low in rigidity to be located on the lateral side in the width direction and causes the support part relatively high in rigidity to be located on the medial side in the width direction, so that the occurrence of pronation upon landing is prevented.

In this case, the medial edge part 210*c* preferably includes a fore edge part 210*c*1 having a shape gradually extending toward the medial side in the width direction while extending from the fore end part toward the rear end part.

In this aspect, transition from the shock-absorbing part to the support part is gradually made toward the medial side in the width direction, so that the occurrence of pronation upon landing is prevented.

Further, it is preferable that the recessed surface 212 include a base surface 212*a*, and an inclined surface 212*b* inclined relative to the base surface, and that the inclined surface have a shape inclined so as to gradually come close to the surface of each of the columnar bodies 214 while extending from a lateral side toward a medial side in the width direction.

In this aspect, the rigidity of the shock-absorbing part 210 gradually increases toward the medial side in the width direction, so that the occurrence of pronation upon landing is prevented.

Further, a dimension g between a pair of the columnar bodies adjacent to each other among the plurality of columnar bodies is preferably larger than or equal to a height dimension h of each of the columnar bodies.

This prevents, when each columnar body 214 has been subjected to shear deformation, the columnar body 214 from coming into contact with a columnar body adjacent to the columnar body 214.

Further, it is preferable that the surface of each of the columnar bodies 214 be formed in a polygonal shape as viewed from above, and that a dimension g between a pair of the columnar bodies adjacent to each other among the plurality of columnar bodies be smaller than a length of each side of the surface of each of the columnar bodies 214.

This makes the number of columnar bodies 214 in the formation range of the shock-absorbing part 210 large enough, so that the shock-absorbing capability is secured.

In this case, the surface of each of the columnar bodies 214 is preferably formed in a polygonal shape with at least five sides as viewed from above.

This enhances the shock-absorbing capability of the shock-absorbing part 210.

For example, each of the columnar bodies 214 may include a shock-absorbing member having a columnar outer shape, the shock-absorbing member having, as outer surfaces, a first end surface ES1 and a second end surface ES2 on opposite sides of the shock-absorbing member in an axial direction that is a direction in which an axis AX1 extends, and a plurality of connection surfaces CS connecting a peripheral edge of the first end surface and a peripheral edge of the second end surface, the first end surface may have an outer shape of an N-sided polygon (N is an integer greater than or equal to 3) as viewed along the axial direction, the second end surface may have an outer shape of an M-sided polygon (M is an integer greater than or equal to 4 and greater than N) as viewed along the axial direction, an (M−N) vertex P may be provided at an intermediate position in the axial direction of a periphery defined by the plurality of connection surfaces, one first ridgeline L1 may be provided so as to extend from the (M−N) vertex provided on the periphery to one of N vertices of the first end surface, two second ridgelines L2 may be provided so as to extend from the (M−N) vertex provided on the periphery to two vertices adjacent to each other in a peripheral direction among M vertices of the second end surface, (2*N−M) third ridgelines L3 may be provided so as to extend from the remaining vertices of the N vertices of the first end surface to the remaining vertices of the M vertices of the second end surface, ridgelines included in the first ridgeline, the second ridgelines, and the third ridgelines do not intersect each other, and the plurality of connection surfaces CS may be defined by the ridgelines included in the first ridgeline, the second ridgelines, and the third ridgelines.

This aspect enhances the shock-absorbing capability of the shock-absorbing part 210.

Alternatively, each of the columnar bodies 214 may include a shock-absorbing structure including a shock-absorbing unit obtained by unitizing a plurality of shock-absorbing members, each of the plurality of shock-absorbing members may include the shock-absorbing member, the plurality of shock-absorbing members may be arranged adjacent to each other so as to cause connection surfaces defined by the first ridgeline and the second ridgelines among the plurality of connection surfaces CS included in each shock-absorbing member to face each other with a gap G provided between the connection surfaces, and a size of the gap G provided between the plurality of shock-absorbing members may be approximately uniform.

This aspect also enhances the shock-absorbing capability of the shock-absorbing part 210.

Further, footwear 1 according to one aspect of this disclosure includes the sole 10 and an upper 20 connected to the sole and located on the sole.

In the footwear 1, it is preferable that the upper 20 include an insole 24 connected to a surface of the sole, the support surface 220*a* be bonded to the insole 24, and the shock-absorbing part 210 be not bonded to the insole 24.

This suppresses a reduction in the shock-absorbing effect of the shock-absorbing part 210 due to an adhesive entering between the columnar bodies 214.

REFERENCE SIGNS LIST

1: footwear, 10: sole, 20: upper, 100: outer sole, 200: midsole, 201: top midsole, 202: bottom midsole, 203: cushioning part, 210: shock-absorbing part, 210*a*: fore end part, 210*b*: rear end part, 210*c*: medial edge part, 210*c*1: fore edge part, 210*c*2: rear edge part, 210*d*: lateral edge part, 212: recessed surface, 212*a*: base surface, 212*b*: inclined surface, 214: columnar body, 214*a*: lateral columnar body, 214*b*: medial columnar body, 214*c*: central columnar body, 220: support part, 220*a*: support surface, 222: medial support part, R1: forefoot region, R2: rearfoot region, R3: midfoot region

The invention claimed is:

1. A sole constituting a part of footwear, the sole comprising:

a shock-absorbing part provided at least in a rearfoot region located at a rear of the footwear in a longitudinal direction, the shock-absorbing part cushioning an impact applied to a heel of a foot upon landing; and a support part provided at least in a midfoot region located at a center of the footwear in the longitudinal direction, the support part being higher in rigidity than the shock-absorbing part and supporting a midfoot portion of the foot, wherein the support part includes a support surface, the support surface being provided forward of the shock-absorbing part and having a shape extending from one end to an other end of the footwear in a width direction, the shock-absorbing part includes a recessed surface located at a height position lower than the support surface, and a plurality of solid columnar bodies each having a shape extending from the recessed surface to a height position identical in height to the support surface, a dimension between each pair of the plurality of columnar bodies directly adjacent to each other without any other of the plurality of columnar bodies between them is larger than or equal to a height dimension of each of the columnar bodies, the surface of each of the columnar bodies is formed in a polygonal shape as viewed from above, and a dimension between each pair of the columnar bodies adjacent to each other among the plurality of columnar bodies is smaller than a length of each side of the surface of each of the columnar bodies.

2. The sole according to claim 1, wherein in a plan view of the columnar bodies, a largest dimension among dimensions of each of the columnar bodies in directions orthogonal to an axial direction of each of the columnar bodies is larger than a height dimension of each of the columnar bodies, and the height dimension of each of the columnar bodies is less than or equal to 30% of a thickness of the sole.

3. The sole according to claim 1, wherein the shock-absorbing part includes a fore end part located at a fore end in the longitudinal direction, a rear end part located at a rear end in the longitudinal direction, and a medial edge part connecting the fore end part and the rear end part and constituting a medial edge of the shock-absorbing part in the width direction, the fore end part is located on a lateral side relative to a center line of the sole in the width direction, and the support part includes a medial support part having a shape extending from the medial edge part toward a medial side in the width direction.

4. The sole according to claim 3, wherein the medial edge part includes a fore edge part having a shape gradually extending toward the medial side in the width direction while extending from the fore end part toward the rear end part.

5. The sole according to claim 1, wherein the recessed surface includes a base surface, and an inclined surface inclined relative to the base surface, and the inclined surface has a shape inclined so as to gradually come close to the surface of each of the columnar bodies while extending from a lateral side toward a medial side in the width direction.

6. The sole according to claim 1, wherein the surface of each of the columnar bodies is formed in a polygonal shape with at least five sides as viewed from above.

7. The sole according to claim 1, wherein each of the columnar bodies includes a shock-absorbing member having a columnar outer shape, the shock-absorbing member having, as outer surfaces, a first end surface and a second end surface on opposite sides of the shock-absorbing member in an axial direction that is a direction in which an axis extends, and a plurality of connection surfaces connecting a peripheral edge of the first end surface and a peripheral edge of the second end surface, the first end surface has an outer shape of an N-sided polygon (N is an integer greater than or equal to 3) as viewed along the axial direction, the second end surface has an outer shape of an M-sided polygon (M is an integer greater than or equal to 4 and greater than N) as viewed along the axial direction, an (M−N) vertex is provided at an intermediate position in the axial direction of a periphery defined by the plurality of connection surfaces, one first ridgeline is provided so as to extend from the (M−N) vertex provided on the periphery to one of N vertices of the first end surface, two second ridgelines are provided so as to extend from the (M−N) vertex provided on the periphery to two vertices adjacent to each other in a peripheral direction among M vertices of the second end surface, (2*N−M) third ridgelines are provided so as to extend from remaining vertices of the N vertices of the first end surface to remaining vertices of the M vertices of the second end surface, ridgelines included in the first ridgeline, the second ridgelines, and the third ridgelines do not intersect each other, and the plurality of connection surfaces are defined by the ridgelines included in the first ridgeline, the second ridgelines, and the third ridgelines.

8. The sole according to claim 1, wherein each of the columnar bodies includes a shock-absorbing structure including a shock-absorbing unit obtained by unitizing a plurality of shock-absorbing members, each of the plurality of shock-absorbing members includes a shock-absorbing member having a columnar outer shape, the shock-absorbing member having, as outer surfaces, a first end surface and a second end surface on opposite sides of the shock-absorbing member in an axial direction that is a direction in which an axis extends, and a plurality of connection surfaces connecting a peripheral edge of the first end surface and a peripheral edge of the second end surface, the first end surface has an outer shape of an N-sided polygon (N is an integer greater than or equal to 3) as viewed along the axial direction, the second end surface has an outer shape of an M-sided polygon (M is an integer greater than or equal to 4 and greater than N) as viewed along the axial direction, an (M−N) vertex is provided at an intermediate position in the axial direction of a periphery defined by the plurality of connection surfaces, one first ridgeline is provided so as to extend from the (M−N) vertex provided on the periphery to one of N vertices of the first end surface, two second ridgelines are provided so as to extend from the (M−N) vertex provided on the periphery to two vertices adjacent to each other in a peripheral direction of M vertices of the second end surface, (2*N−M) third ridgelines are provided so as to extend from remaining vertices of the N vertices of the first end surface to remaining vertices of the M vertices of the second end surface, ridgelines included in the first ridgeline, the second ridgelines, and the third ridgelines do not intersect each other, the plurality of connection surfaces are defined by the ridgelines included in the first ridgeline, the second ridgelines, and the third ridgelines, the plurality of shock-absorbing members are arranged adjacent to each other so as to cause connection surfaces defined by the first ridgeline and the second ridgelines among the plurality of connection surfaces included in each shock-absorbing member to face each other with a gap provided between the connection surfaces, and a size of the gap provided between the plurality of shock-absorbing members is approximately uniform.

9. Footwear comprising:

a sole according to claim 1; and an upper connected to the sole and located on the sole.

10. The footwear according to claim 9, wherein the upper includes an insole connected to a surface of the sole, the support surface is bonded to the insole, and the shock-absorbing part is not bonded to the insole.

* * * * *